United States Patent [19]

Rippe

[11] Patent Number: 4,848,114

[45] Date of Patent: Jul. 18, 1989

[54] LOCKING SYSTEM FOR THE DOORS OF AUTOMOTIVE VEHICLES

[76] Inventor: Mary R. Rippe, 4500 Fox Creek La., Pacific, Mo. 63069

[21] Appl. No.: 158,888

[22] Filed: Feb. 22, 1988

[51] Int. Cl.[4] ..... E05B 53/00

[52] U.S. Cl. ..... 70/263; 70/257

[58] Field of Search ..... 70/264, 262, 263, 237, 70/256, 257; 292/DIG. 25, 201, DIG. 65

[56] References Cited

U.S. PATENT DOCUMENTS

| | | | |
|---|---|---|---|
| 3,747,379 | 7/1973 | Cabanes | 70/264 |
| 3,751,950 | 8/1973 | Leger | 70/264 |
| 3,924,427 | 12/1975 | San Jacquin | 70/264 |
| 4,458,930 | 7/1984 | Goike | 292/201 |
| 4,468,942 | 9/1984 | Grabner | 70/264 |

*Primary Examiner*—Robert L. Wolfe

*Attorney, Agent, or Firm*—Gravely, Lieder & Woodruff

[57] ABSTRACT

An automotive vehicle has a body provided with a passenger compartment and a luggage compartment. Doors, which close the passenger compartment, carry latches which engage the body to secure those doors. While the doors have exterior handles which are connected to the latches to release the latches, at least when the latches are set to an unlocked condition, each latch may be shifted to a locked condition in which the exterior handle for its door will not release it. Each door also carries an electrical actuator which is coupled to the latch of the door to shift that latch between its locked and unlocked conditions. Two of the doors carry switches which are accessible from the passenger compartment and when operated will cause electrical actuator to shift the latches in unison to their locked or unlocked conditions, depending on the manner in which the switch is manipulated. In addition, the luggage compartment contains a remote switch which is connected to all of the actuators and when operated causes the actuators to shift all latches to their unlocked condition.

10 Claims, 1 Drawing Sheet

LOCKING SYSTEM FOR THE DOORS OF AUTOMOTIVE VEHICLES

BACKGROUND OF THE INVENTION

This invention relates in general to automotive vehicles, and more particularly to locking systems for securing such vehicles.

Many automobiles of current manufacture come equipped with electrical locking systems, and for the most part, these systems are merely adaptations of or additions to conventional manually operated systems. Whereas the traditional manually operated system has a knob or some other operating device located on each door for setting the latch of its door, the electrical locking system in addition includes an electrical actuator on each door and, on at least the front doors, electrical switches which energize all of the actuators in unison. The knobs or other operating devices of the traditional manual systems are usually connected to their respective door latches through linkages. In the typical electrical system, the electrical actuators merely tie into these linkages, so that when an actuator is energized, it moves the manual operator as well. Usually each front door is equipped with a switch which is connected between the electrical power source for the vehicle and the electrical actuators on all of the doors. Thus, by manipulating the switch at either front door, one can energize the electrical actuators on all doors to either lock or unlock the doors. Of course, if the vehicle is fully locked, one must have access to the vehicle itself before either switch can be operated, and this requires a key to release the latch on one of the front doors so that the door may be opened. In that sense, the electrical locking system is of little benefit to one who is totally outside a fully locked automobile.

The luggage compartments or trunks of automobiles are likewise secured with key-operated locks which are accessible from the exterior of the vehicle. Often one upon approaching his or her automobile opens the trunk lid first to place a package in the trunk, and after closing the trunk opens one of the doors to enter the passenger compartment of the vehicle. For example, shopping for groceries usually leaves one with several large bags of food products. The most convenient place to transport these groceries is in the trunk of the individual's automobile, and that is where they are usually placed, but only after unlocking the trunk lid with a key and raising it. Then to enter the vehicle, the same key or a different key must be inserted into and turned within one of the door locks. The operation of two key-operated locks presents somewhat of an inconvenience.

Many automobiles with electrical locking systems have an electrical actuator for the trunk lock as well, and the switch for energizing this actuator is usually located within the glove compartment of the vehicle. Hence, one by unlocking the door and then operating the trunk lock switch, can release the trunk lid without going through more than one key-operated lock, but that procedure is just as inconvenient as unlocking two key-operated locks.

The present invention resides in an electrical locking system for automobiles, and that locking system includes the traditional electrically-operated actuator on each door as well as door-mounted switches for energizing the actuators. In addition, it includes a switch in the luggage compartment, and that switch, when operated, will also energize the electrical actuators for the door to release the latches on such doors.

DESCRIPTION OF THE DRAWINGS

In the accompanying drawings which form part of the specification and wherein like numerals and letters refer to like parts wherever they occur

DETAILED DESCRIPTION

Figure 1:
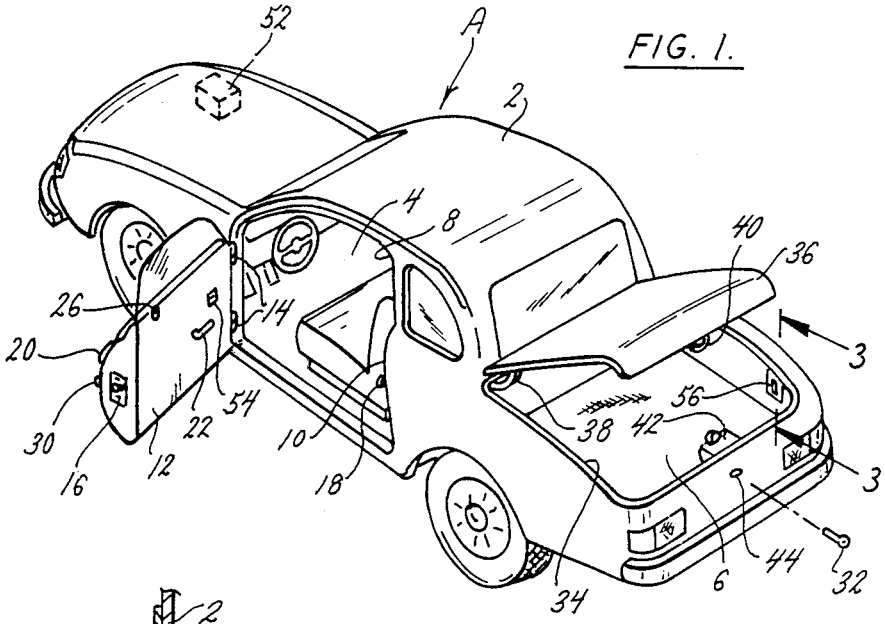
FIG. 1 is a perspective view of an automobile provided with the electrical locking system of the present invention.

Referring now to the drawings, an automotive vehicle A (FIG. 1) includes an electrically-operated locking system for securing the vehicle A when it is left unattended. The locking system may be energized from several locations on the vehicle A to facilitate entry to the vehicle.

The vehicle A includes a body 2 which encloses a passenger compartment 4 and a luggage compartment 6. Access to the passenger compartment 4 is gained through door openings 8 located at the sides of the body 2, there being at least one door opening 8 on each side of the body 2, and along each door opening 8 the body 2 has a door post 10. The door openings 8 are normally closed by doors 12 which are attached to the body by hinges 14, so that they can swing between open and closed positions. Each door 12 carries a latch 16 which aligns with a keeper 18 on the door post 10 for the opening 8 at which it is located, and when the door 12 is closed, its latch 16 engages the keeper 18 to secure the door 12 in its closed position. In addition, each door 12 has an exterior handle 20 and an interior handle 22. As its name suggests, the former is along the outwardly presented surface of the door 12 and may be operated by one who is outside the vehicle A, whereas the latter is along the inwardly presented surface of the door 12 and may be operated by an individual who is within the passenger compartment 4.

Figure 2:
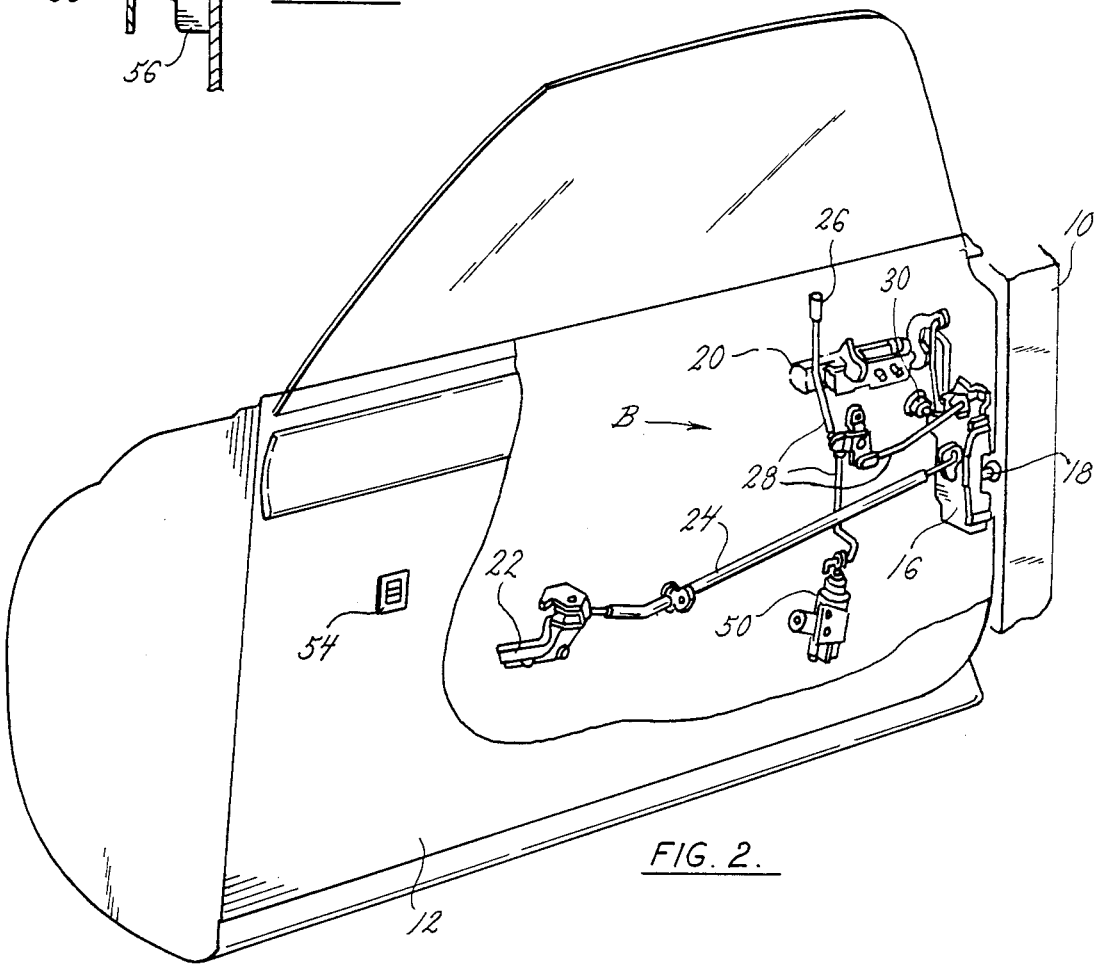
FIG. 2 is a perspective view, partially broken away, of an automobile door containing components of the electrical locking system.

Both the exterior and interior handles 20 and 22 for each door 12 are connected through a linkage system 24 (FIG. 2) to the latch 16 for the door 12 such that when either handle 20 or 22 is lifted, pulled or otherwise operated, the latch 16 is released from its keeper 18, freeing the door 12 so that the door 12 may swing open. Each latch 16 includes a mechanism which when set prevents the latch 16 from disengaging its keeper 18 upon operation of the exterior handle 20. In other words, the latch 16 is capable of assuming a locked condition or an unlocked condition. In the unlocked condition, it will release the keeper 18 when the exterior handle 20 is lifted, but not when in the locked condition. The interior handle 22, when operated, causes the latch 16 to disengage the keeper 18 irrespective of whether the latch 16 is in its locked or unlocked condition. The locking mechanism of the latch 16 is set—that is changed between its locked and unlocked conditions—with an operating knob 26 which is exposed along the inwardly presented surface of the door 12, so that it can be operated by occupants within the passenger compartment 4 to secure the passenger compartment 4 while it is occupied. The knob 26 is connected to the latch 16 by a linkage 28.

In addition, two of the doors 12—one on each side of the body 2—carry key-operated locks 30 which are exposed on the outwardly presented surfaces of the doors 12 adjacent to the exterior handles 20 for the doors 12. Each is operated by a single key 32 which may or may not be the same key as that which operates the ignition system for the vehicle A. When the key 32 is inserted into either lock 30 and turned in one direction, it brings the locking mechanism of the latch 16 to its locked condition. When turned in the opposite direction by the key 32, the lock 30 shifts the latch 16 to its unlocked condition where the latch 16 can be released with the exterior handle 22.

The luggage compartment 6 opens rearwardly from the body 2 through a trunk opening 34 (FIG. 1), which is normally closed by a trunk lid 36 that is attached to the body 2 with hinges 38 located at the front of the opening 34. At the rear of the opening 34, the lid 36 is fitted with a keeper 40 which aligns with a latch 42 at the rear of the compartment 6. Indeed, when the trunk lid 36 is forced downwardly, the latch 42 will engage the keeper 40 and secure the lid 36 in its closed position. The latch 42 is connected to a key-operated lock 44 which is exposed on the outwardly presented surface of the body 2. The lock 44 accepts the key 32 and when the key 32 is turned within the lock 44, the lock 44 causes the latch 42 to release the keeper 38, so that the lid 36 may swing upwardly and expose the luggage compartment 6.

The latches 16, operating knobs 26 and key-operated locks 30 for the doors 12 constitute part of a manual locking system for securing the vehicle A. In addition, the vehicle A has an electrical locking system which cooperates with the manual system. The electrical system includes a separate actuator 50 (FIG. 2) for each door 12, with that actuator 50 being connected to the linkage system 28 by which the operating knob 26 for its door 12 is coupled to the latch 16 of the door 12. Like the knob 26 for the door 12, the electrical actuator 50 for the door 12 is capable of moving the linkage system 28 such that it places the latch 16 either in a locked or an unlocked condition, and in that sense the actuator 50 is double acting. Of course, when the latch 16 is locked, it cannot be released from its keeper 18 by operation of the exterior handle 20, but when unlocked, operation of the handle 20 will cause the latch 16 to disengage the keeper 18 and free the door 12 so that the door 12 will open.

The electrical energy for operating the actuators 50 derives from a battery 52 (FIG. 1) which is housed within the body 2 and operates other electrical components of the vehicle A. Indeed, each actuator 50 is connected to the battery 52 through two switches 54 which are connected in parallel. One of the switches 54 is carried by the left front door 12, while the other is on the right front door. Being in parallel, either switch 54 will energize all of the actuators 50. Each switch 54 has three positions—a neutral position, a lock position, and an unlock position. In the neutral position, which is the position to which the switch 54 reverts when not manipulated, the switch 54 creates an open circuit between the battery 52 and the several actuators 50. When moved to the lock position, it places each actuator 50 across the battery 52 such that the actuator 50 moves its door latch 16 to the locked condition, that is the condition in which the handle 20 on the door 12 which contains the actuator 50 will not release the latch 16 from its keeper 18. When moved to its unlocked position, the switch 54 places each actuator across the battery 52 such that the actuator 50 moves its door latch 16 to the unlocked condition in which it disengages its keeper 18 when the exterior handle 20 for the door 12 on which it is mounted is operated. The two switches 54 are located along the inwardly presented surfaces of the two front doors 12 so that they are accessible to occupants within the passenger compartment 4. They are not accessible to anyone at the exterior of the vehicle A, at least when the doors 12 on which they are mounted are closed.

Figure 3:
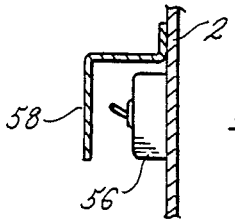
FIG. 3 is a sectional view taken along line 3—3 of FIG. 1 and showing the trunk switch and the shield which protects it.

In addition to the actuators 50 and the two switches 54, the electrical locking system also includes another switch 56 (FIG. 1) which is mounted in the luggage compartment 6 of the body 2 such that it is accessible to anyone standing immediately behind the luggage compartment 6 with the trunk lid 36 open. The switch 56 is connected in parallel with the switches 54 and possesses two positions—a neutral position and a lock position. When in the neutral position, to which it normally reverts, the switch 56 produces an open circuit between the battery 52 and the several actuators 50, so that the actuators 50 remain inoperative, at least through the switch 56. On the other hand, when the switch 56 is moved to its unlocked position, it places all of the actuators 50 across the battery 52 such that each actuator 50 moves its respective latch 16 to its unlocked condition, the condition in which it will disengage its keeper 18 when the exterior handle 20 for the door 12 on which it is located is lifted or otherwise operated. In short, the trunk switch 56 when momentarily moved to its unlocked position causes the electrical locking system to unlock all of the doors 12. Thus, one from within the luggage compartment 6 can bring every door latch 16 into its unlocked condition, so that each door 12 can be opened merely by lifting or otherwise operating the exterior handle 20 for that door 12. The switch 56 is covered by a shield 58 (FIG. 3) so that loose objects within the luggage compartment 6 may not come against it and actuate it.

The remote switch 56 facilitates gaining access to the passenger compartment 4 of the vehicle A when one has goods which must first be placed in the luggage compartment 6. This is not an uncommon experience, particularly for those who frequent large food stores. Typically, one upon leaving a food store has several large bags of groceries which might be carried to the vehicle A in a shopping cart. At the vehicle A, one merely inserts the key 32 into the lock 44 for the trunk lid 36 and turns the key 32 to release the trunk latch 42 from its keeper 40. The trunk lid 36 can then rise to expose the luggage compartment 6. At this time the individual reaches into the luggage compartment 6 and momentarily moves the switch 56 from its neutral to its unlocked position. The switch 56 causes the battery 52 to energize all of the actuators 50, and they set the latches 16 for the doors 12 on which they are mounted, so that the exterior handles 20 will release those latches 16 from their respective keepers 18. Once the bags of groceries are loaded into the luggage compartment 6, the trunk lid 36 is closed so that its latch 42 engages the keeper 40 and holds the lid 36 closed. The individual then goes to one of the doors 12 and opens it merely by operating its exterior handle 20. The individual need not again place the key 32 in one of the door locks 28 to release the latch 16 for the door 12.

While the electrical locking system has been described in connection with a sedan-type vehicle A where the passenger compartment 4 and luggage compartment 6 are separate, it also has utility in connection with vehicles, such as station wagons, where no distinct partition exists between the two compartments 4 and 6.

This invention is intended to cover all changes and modifications of the example of the invention herein chosen for purposes of the disclosure which do not constitute departures from the spirit and scope of the invention.

What is claimed is:

1. In an automotive vehicle including a body and doors fitted to the body to enclose a passenger compartment within the body, each door having a single latch, which will engage a keeper on the body as the door is closed to retain the door in a closed position, and an exterior handle, which is connected to the latch such that, when the handle is operated, the latch will release the keeper, the latch being shiftable between a locked condition, wherein operation of the handle will not release it from its keeper, and an unlocked condition wherein the operation of the handle will release it from the keeper, an electrically operated actuator in at least one of the doors where it is connected to the single latch on that door for changing the latch between its locked and its unlocked condition when energized, and a battery housed in the body for supplying the electrical energy for operating the actuator, the improvement comprising: a remote switch located on the body remote from the passenger compartment and connected between the actuator and the battery, the remote switch being capable of placing the actuator across the battery when operated such that the actuator causes the single latch on said one door to assume its unlocked condition.

2. The combination according to claim 1 wherein the body further contains a luggage compartment and the remote switch is in and accessible from the luggage compartment.

3. The combination according to claim 2 and further comprising a lid normally extended over the luggage compartment, a lid latch for securing the lid to the body in a closed position, and a key operated lock connected to the lid latch for releasing the lid latch to gain access to the luggage compartment.

4. The combination according to claim 1 and further Comprising a door switch located on at least one of the doors and being exposed to the passenger compartment when the door is closed, the door switch also being connected between the battery and the actuator and further being capable of placing the actuator across the battery such that the latch can assume its locked or its unlocked condition.

5. The combination according to claim 4 wherein each door carries an electrically operated actuator and the remote and door switches are connected between the battery and the actuators so that each, if operated individually, can energize all of the actuators simultaneously.

6. The combination according to claim 5 wherein the body further contains a luggage compartment and the remote switch is in and accessible from the luggage compartment.

7. The combination according to claim 5 wherein at least one door carries a key-operated lock that is connected to the latch such that when a key within the lock is turned, the latch is changed between its locked and unlocked conditions.

8. An automotive vehicle comprising: a body having a passenger compartment and a luggage compartment; doors attached to the body and normally being in a closed position in which they close the passenger compartment; latch means on each door for engaging the body as the door is closed to retain the door in its closed position, but being releaseable from the body to enable the door to open, each latch means being shiftable between locked and unlocked conditions; a handle carried on each door and being movable with respect to its door, the handle for each door being connected to the latch means for the door such that the handle, when moved, will release the latch means if the latch means is in its unlocked condition, but not if it is in its locked condition; an electrical battery housed in the body; a key-operated lock on at least one of the doors where it is connected to the latch means for that door for causing the latch means to assume its locked or unlocked condition when a key within the lock is manipulated; an electrical actuator in each door and connected to the latch means for changing the latch means from its locked to its unlocked condition and vice-versa when placed across the battery; a door switch located at at least one of the doors and being electrically interposed between the battery and all of the actuators for, when operated, causing the actuators to change the latch means in unison between their locked and unlocked conditions; and a remote switch located in the luggage compartment and being electrically interposed between the battery and the actuators for, when operated, causing the actuators to assume in unison their unlocked condition.

9. An automotive vehicle according to claim 8 and further comprising a closure attached to the body and normally closing the luggage compartment, a latch for securing the closure for luggage compartment in its closed position, and key-operated lock connected to the latch for causing the latch to release the closure

10. An automotive vehicle according to claim 8 wherein each door has a single latch means and a single actuator connected to that latch means.

* * * * *